United States Patent [19]

Heiberger

[11] Patent Number: 5,060,752

[45] Date of Patent: Oct. 29, 1991

[54] SOUND-PROOFING FOAM PANELS

[76] Inventor: Franz Heiberger, Glastalstrasse 11, 7427 Hayingen, Fed. Rep. of Germany

[21] Appl. No.: 403,196

[22] Filed: Sep. 5, 1989

[51] Int. Cl.[5] ..... E04B 1/82

[52] U.S. Cl. ..... 181/291; 181/200

[58] Field of Search ..... 181/200, 202–204, 181/290, 291, 287, 295; 160/135, 368.1

[56] References Cited

U.S. PATENT DOCUMENTS

| | | | |
|---|---|---|---|
| 2,253,953 | 8/1941 | Dunbar | 181/290 |
| 2,357,115 | 8/1944 | Jack, 3rd et al. | 181/290 X |
| 2,508,506 | 5/1950 | Fridolph | 160/135 X |
| 3,441,465 | 4/1969 | Pearson | 181/290 X |
| 3,571,999 | 3/1971 | Downing | 160/135 X |
| 3,881,569 | 5/1975 | Evans, Jr. | 181/200 |
| 3,889,736 | 6/1975 | Firks | 160/135 |
| 4,068,428 | 1/1978 | Peterson, III | 52/DIG. 13 X |
| 4,120,376 | 10/1978 | Palmer | 181/204 |
| 4,480,715 | 12/1984 | Brooks | 181/287 |
| 4,702,046 | 10/1987 | Haugen et al. | 181/286 X |
| 4,744,189 | 5/1988 | Wilson | 52/DIG. 13 X |
| 4,823,909 | 4/1989 | Nakamura et al. | 181/291 X |
| 4,838,380 | 6/1989 | Lassiter | 181/291 |
| 4,858,561 | 8/1989 | Springer | 160/368.1 |
| 4,926,609 | 5/1990 | Arico | 52/DIG. 13 X |

*Primary Examiner*—L. T. Hix

*Assistant Examiner*—Howard B. Blanksenship

[57] ABSTRACT

A sound-proofing panel for the cladding of machine tools consists of a foam board (28) of a thickness of at least approximately 10 cm., over which is glued a tear-resistant plastic sheet (38). The connection to the frame (12, 14) of the machine is made by means of self-catching strip fastenings (27).

23 Claims, 3 Drawing Sheets

SOUND-PROOFING FOAM PANELS

This invention relates to a large-surface, sound-proctiing machine-cladding panels and to booths producable from such panels.

BACKGROUND OF THE INVENTION

Machines often have a frame as a stand. The space which is available between the frame legs and which is usually limited rectangularly is clad with metal plating. Such plate-metal claddings are in terms of their area of the order of 0.5 m 2 to 5.0 m 2, but can also be more or less than this. The plate-metal claddings have several purposes:

a) They perform an aesthetic function and an attempt is made to ensure that the machine has an agreeable appearance.

b) Spatial delimitation between the machine interior and the machine exterior is obtained. This is advantageous, for example, for safety reasons, so that no one can reach into the machine, or so that no articles fall into the machine. Very often, however, the machine-cladding panels also have the function of damping the sound which the machine generates within the stand. Examples of this are vibration-grinding machines or other types of special machines. The panels are arranged essentially vertically. They consist of metal plating which first has to be surface-treated such as, for example, lacquered or otherwise color-treated.

For sound insulation, anti-drumming material is adhesively bonded to the plates from the rear. This performs merely the function of removing the drumming of the plating, since foam material is additionally added to the anti-drumming material.

The sound insulation becomes the more difficult, the longer the sound wave. At low frequencies, heavy-duty sheeting is bonded on. At especially low frequencies, it may also be necessary to include a thin lead plate. The panels thereby become even heavier. Where large panels are concerned, three men are even needed for handling them.

When the metal plates are canted off so that no injuries from cuts are caused at the edges, and so that the plates become even more rigid, this is reflected in the price. Moreover, the panels can then be fitted into the machine stands only with much more difficulty. Another disadvantage of the state of the art is that the metal plates have to be screwed on, and this necessitates a high accuracy of fit between the passage hole in the plate and the threaded screw hole on the machine stand. Tools are also needed. Threads are destroyed in the course of time and have to be recut. Furthermore, a screw fastening, since it is essentially rigid, is an undesirably efficient sound bridge. These sound bridges are precisely what nullifies the excellent insulation elsewhere. Such plates can also easily be warped during operation if, for example, a fork-lift truck bumps against them, and they can even be warped to the extent that they become useless. The plates have to be surface-treated, i.e. galvanized or lacquered.

When the plates are removed, they have to be arranged in an orderly fashion in the plant and it is necessary to ensure that they do not fall over, because they would otherwise be damaged.

Subsequent changes are very difficult to make, because in practice, new plates then have to be manufactured again or they have to be reconstructed at a very high outlay. Such reconstruction is necessary when an inspection window has to be built into such a plate.

As is known, metal plating has good heat conduction and consequently it has not been possible for the metal plates to be used for thermal insulation in addition to sound insulation.

If the metal plates have a slight oversize they cannot be pressed into the orifices to be closed, because, of course, plate-metal does not yield. High precision manufacture is therefore necessary.

Sometimes the entire surface has to be composed of two individual surfaces for reasons of weight. In this case a reinforcing post is employed where there is a gap between the individual plate-metal panels, so that the two plate end regions cannot vibrate. This is a solution involving a high outlay.

OBJECTS AND STATEMENT OF THE INVENTION

The objects of the invention are to provide large surface, sound-proofing, machine-cladding panels and booths produced from such panels that avoid the disadvantages mentioned above. In particular, it is to be possible, at a substantially lower outlay, to have a capacity for at least equal, if not better insulation, specifically at least against sound. At the same time, it is to be possible to manufacture the machine stands in the known way. There will therefore be no need to change the construction of the machines for the sake of better sound-proofing.

Panels of the kind described have a first layer of sound-proofing material extending in the form of a panel, a second layer connected to said first layer over a common large surface, and a first half of a connecting device on said panel for fastening said panel to a machine or the like by means of a second half of said connecting device.

The objects of the invention are achieved by means of the following features:

a) said sound-proofing material is a foam material having a thickness of at least approximately 10 cm, a plane front face, a rear face spaced from said front face by the thickness of said foam material, and circumferential faces connecting said front face and said rear face;

b) said second layer is a thin sheet in relation to said foam material thickness, is connected materially on its rear face to said front face of said foam material over a large surface, has wrap-around portions that extend around said circumferential faces of said foam material at least as far as said rear face of said foam material and is materially connected to said rear face of said foam material over a large surface; and c) said first half of said connecting device is one half of a mutiply reusable surface fastener that is releasable by manual force.

As used in this specification, the term "thin sheet" means a plastic foil. Advantageously, the plastic foil is reinforced with fabric.

The invention has at least the following advantages:

a) Even very large panels can be handled by only one man. The storage of the panels presents no problems. The sound-proofing is substantially better than hitherto, despite a simpler technology. Although the panels can be larger, they are more rigid than plate-metal panels of equal size. No screws and no tools are required. Accuracies of fit are not involved. There are no sound bridges. Screws cannot fall into the machine. Anyone will immediately understand the operations of assembly and removal. The aesthetic appearance is excellent, since the sheet is already on the market in many colors and patterns for other purposes, such as, for example, for tarpaulins.

The embodiment described includes the following additional advantageous features.

The foam material is of the type of the cores used for sports mats. It is possible to use cores which are already on the market for other purposes, the properties of which have been known for a long time and which, as is known, are capable of absorbing the worst shocks without damage.

The foam material is continuous in one piece at least over the width and height of the panel. This ensures high rigidities without discontinuities which would occur if the core were glued together from several pieces of foam.

The foam material is composed of regenerated foam. It has been shown that such foam material is fully satisfactory, and therefore a new field of use for regenerated foam has been found.

The foam material is selected from the group consisting of composite foam, polyethylene foam and polyether/polyester foam. Foam materials of these types have proved highly appropriate in practice, and this of course also applies to foam materials of a similar type.

The foam material is chosen to contain an air fraction that is smaller when a frequency to be damped is lower. As a result, it is possible to adapt to the different frequencies which mainly occur.

The front face and the rear face of the foam material are parallel to one another. The rigidity of the device remains the same everywhere. If, for example, the core were thicker in the middle region, then the rigidity conditions over its length would also be different.

The circumferential faces of the foam material are perpendicular relative to said front face of said foam material. By virtue of this feature, the slits between the frame legs of the machine and circumferential faces become very long and narrow, so that no sound can escape outwards through them. If the device is made a little oversize, there is even a slit of "zero" width over the breadth of the circumferential faces.

The foam material is in the form of a flat rectangle. This feature makes it possible to ensure that the core can be cut by means of simple cuts perpendicular relative to one another.

The thin sheet is reinforced with a fabric. Devices especially resistant to bending are obtained as a result of this feature, and the device becomes substantially more rigid than either of the two components in itself, but also more rigid than plate-metal when the dimensions are large. The structure of the fabric largely results in a roughening of the surface of the sheet, so that better adhesive bonding is also possible.

The thin sheet is of low extensibility, and the fabric is of low extensibility. By means of these features, the low extensibility can be transmitted to the fabric, this leading to better results, and the filling material of the sheet can then perform other functions and need not be of such high quality.

The fabric has a high resistance to tear propagation. This feature maintains the rigidity and protective function of the sheet for the core, even if a tear were to form anywhere.

The thin sheet is adhesively bonded over a large surface to the circumferential faces of the foam material. This feature further stiffens the device.

The first half of the surface fastening is attached to the thin sheet on circumferential faces thereof. This feature makes it possible to couple devices to one another in a simple way, without having to provide intermediate carriers.

The thin sheet has wrap-around portions laid back onto the rear face of the foam material, which carry the first half of the surface fastening. As a result, the surface fastening cannot be torn off from the core, and moreover the wrap-round providing rigidity is itself stiffened further.

The first half of the surface fastening is hookvelvet. An especially simple form of a surface fastening with known properties is the result, wherein an acoustic decoupling also takes place within the hookvelvet, because of course it is resilient in acoustic terms.

The first half is the hook part of the hookvelvet. This feature provides the more rigid part of the hookvelvet on the device, thus further stiffening the latter.

The surface fastening consists of individual pads that are small in relation to the surface of the panel. By virtue of this feature, the force for opening the surface fastening becomes very low and also only a little material is needed for the surface fastening.

At least one pad is provided in four corner regions of approximately flat rectangular panels of the wrap-around portions of the thin sheet. A fastening having this feature is sufficient even for large-surface devices.

The other half of the surface fastening is provided on a tab which extends from an interior of a machine stand frame into a space to be filled by the panel. This feature ensures a simple counterface which is easy to produce and can easily be attached to the frame and also does not cause any obstruction.

The foam material consists of at least two sandwich layers with at least one stiffening insert, which are connected to one another materially and over their entire surface. As a result, extremely large devices can be stiffened so that they do not buckle when handled. If the stiffening inserts are made of plastic, the weight scarcely changes at all. Furthermore, the stiffening inserts have even better properties when they are included in the bonding operation.

A booth is comprised of walls produced at least partially from panels according to the invention. It is possible to produce such booths with the best possible sound insulation properties, even though they are substantially less expensive than the booths known hitherto. Because of their very low weight, they can also easily be transported or stored in a dismantled state.

A panel forms a door, and door-hinge sockets are embedded into a door edge of said panel forming said door and into a panel forming an associated wall. As a result, doors can also be provided without the need to resort to metal technology for these.

DESCRIPTION OF THE DRAWINGS

A preferred embodiment of the invention is now described. In the drawings.

DETAILED DESCRIPTION

Figure 1:
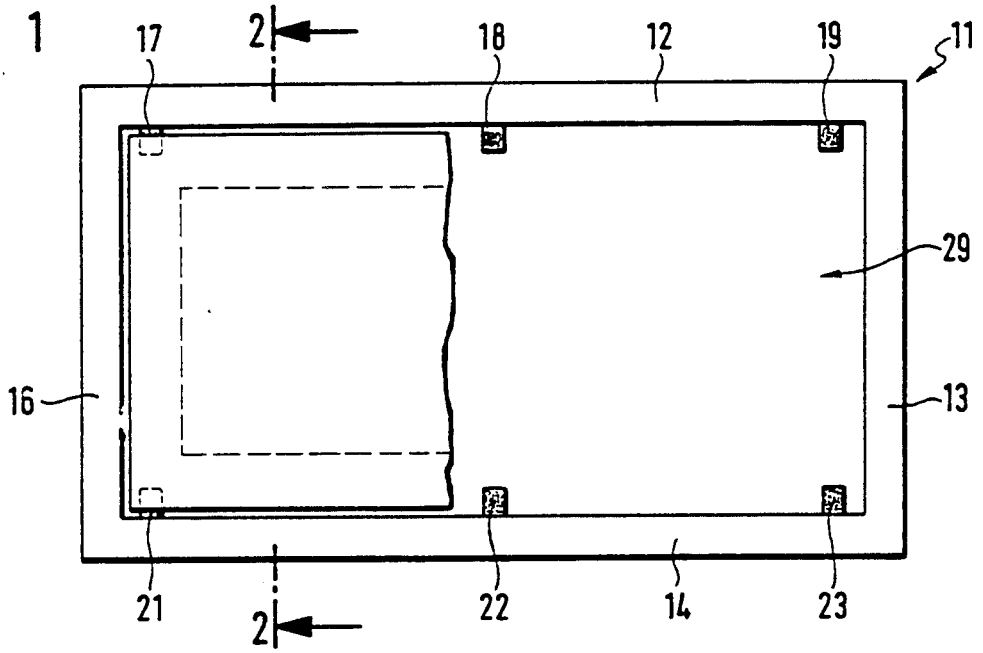
FIG. 1 shows a front view of a machine-stand frame filled with a device according to the invention shown truncated.
Figure 2:
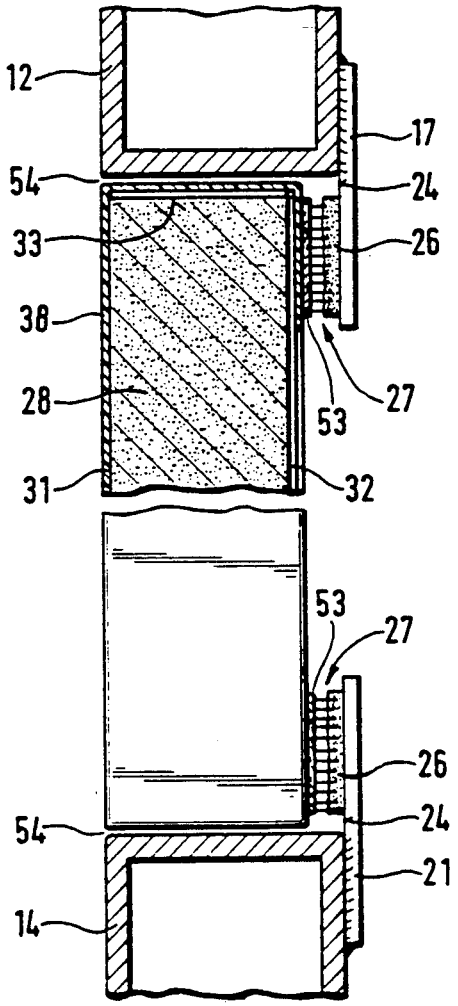
FIG. 2 shows a section along the line 2—2 of FIG. 1, but partially not in section.

A machine otherwise not shown has a frame 11 consisting of four frame legs 12, 13, 14, 16, forming a rectangular frame, in which the frame legs 12 and 14 are parallel to one another and frame legs 13 and 16 are in turn parallel to one another and perpendicular relative to those first mentioned. They are produced from a rectangular raw section and are made of steel. Three metal tabs 17, 18, 19 are welded to the rear face of the frame leg 12, there being here a flat iron section. The tabs 17, 19 are provided in the corner region and the tab 18 is provided in the middle region. They project a few centimeters downwards and are of equal size and equal length. Tabs 21, 22, 23 extend upwards from the frame leg 14 in an exactly corresponding way, as seen from above. A coating strip 26 of a hookvelvet 27 is adhesively bonded to each tab 17 to 23 on its face 24 directed outwards. The area of each coating strip 26 is in the range of 5 to 15 cm 2.

A core 28 of foam material is cut in the form of a flat rectangle so that it just fits into the compartment 29. It is 6 cm thick and is therefore essentially as thick as the frame legs 12 to 16 are wide. The core 28 has a plane front face 31, a plane rear face 32 parallel to this and plane circumferential faces 33, 34, 36, 37, perpendicular relative to these.

A foil 38 is reinforced in a linen weave by means of fabric 39. The foil 38 has a blank according to FIG. 3.

Figure 3:
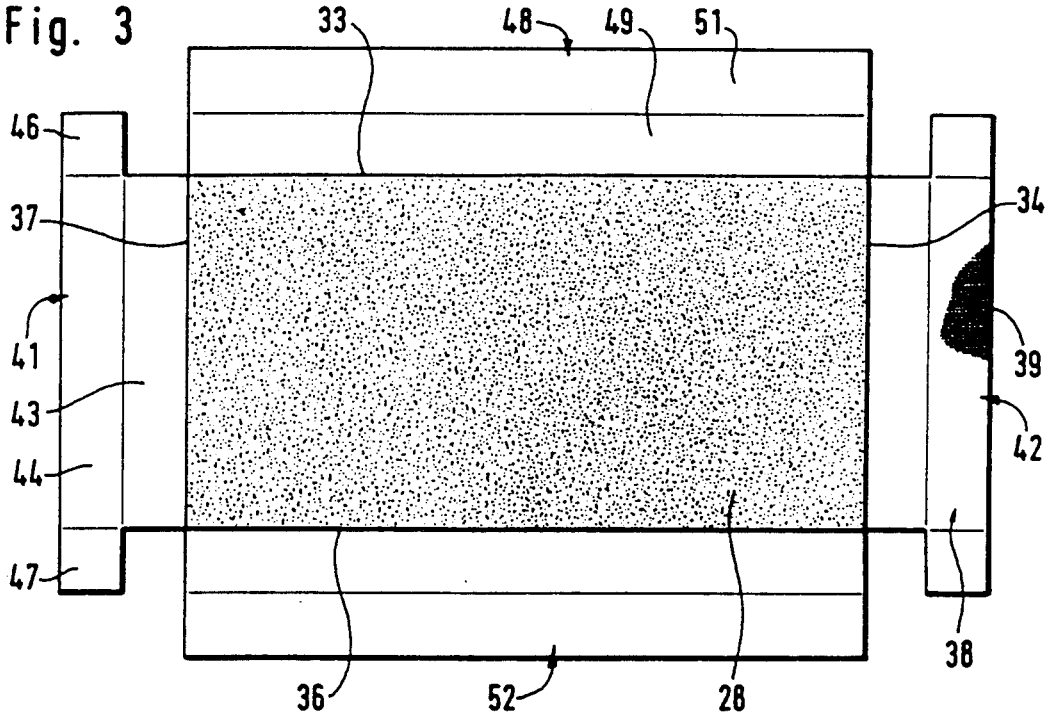
FIG. 3 shows a blank of the sheet with a foam core laid on it.

Sheet 38 has on one end a wing 41, which has faces 43, 44, 46 and 47. Sheet 38 has on its opposite end a wing 42 which has corresponding faces, e.g. face 39. At top and bottom in FIG. 3, sheet 38 has a wing 48, which has faces 49, 51 and a wing 52, which includes corresponding faces. The core 28, on its front face 31, is adhesively bonded over its entire surface (i.e. not only over part regions) to the correspondingly large rectangular face of the foil 38. All the other faces visible in FIG. 3 are also subsequently bonded adhesively to the core 28. For this, appropriately first, the left and right wings 41, 42 are swung up. For the wing 41 the face 43 then rests bonded against the circumferential face 37. The face 44 rests against the rear face 32 of the core in its left edge region and is likewise adhesively bonded over its entire surface. In the view of FIG. 3, the faces 46, 47, turned down, rest bonded against the circumferential face 33, 36 over their entire surface.

The same applies analogously to wing 42. Accordingly, the wing 48 is adhesively bonded over its entire surface, the face 49 resting on the faces 46 and on the circumferential face 33, and the face 51 resting bonded over its entire surface externally on the faces 44 and otherwise on the rear face 32 of the core 28.

The same applies analogously to the wing 52.

Figure 4:
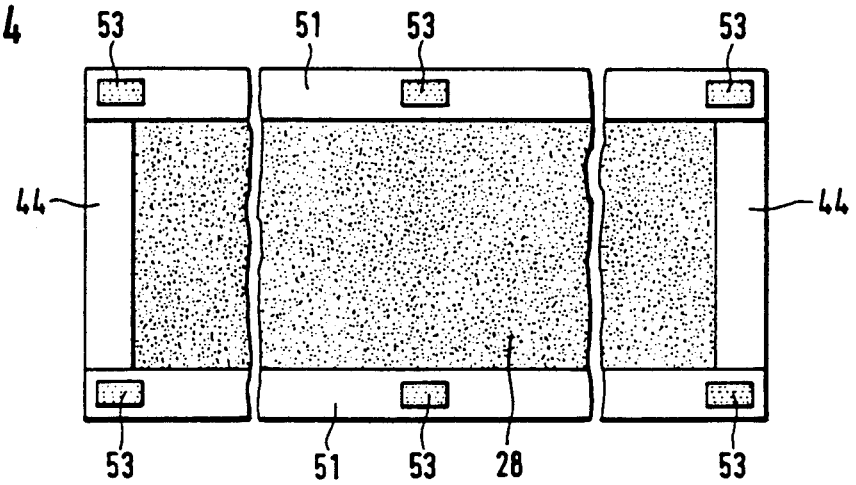
FIG. 4 shows the rear view of a device according to the invention shown truncated.
Figure 5:
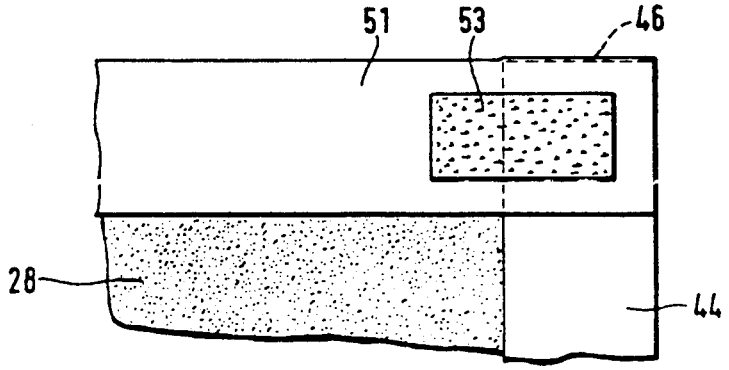
FIG. 5 shows an enlarged view of the top right region of FIG. 4.

According to the FIGS. 4 and 5, hookstrips 53 are glued in an overlapping manner onto the faces 44 and 51, where corner regions are concerned, as shown clearly in FIG. 5. In the middle region of the device according to FIG. 4, the hookstrips 53 are glued to the faces 51 only from outside. The hookstrips 53 are cut longer than the tabs 17, 18, 19, 21, 22, 23 are wide so hookstrip 53 always meets a coating strip 26.

The procedure for cutting the core 28 to size can also be such that the device according to the invention fits into the compartment 29 under a slight internal compression, that is to say has a certain oversize in the untensioned state so that no gaps 54 at all are formed. The device then to a considerable extent holds itself in the compartment 29 and the surface fastening 26, 53 then perform only a certain auxiliary function.

Figure 6:
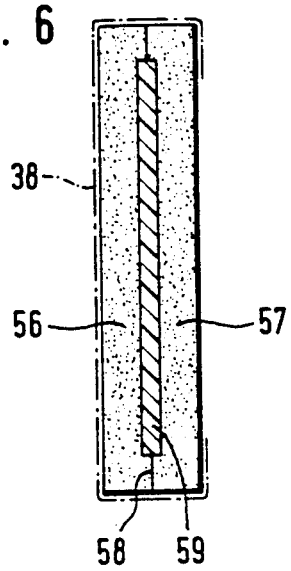
FIG. 6 shows a cross-section through a device according to the invention with inserted stiffening bars.

FIG. 6 shows 2 core halves 56, 57 which are adhesively bonded to one another over the entire surface along their inner faces 58 confronting one another, plastic bars 59 being glued in between them and serving for further stiffening. The foil 38 is represented by dot-dashed lines.

Figure 7:
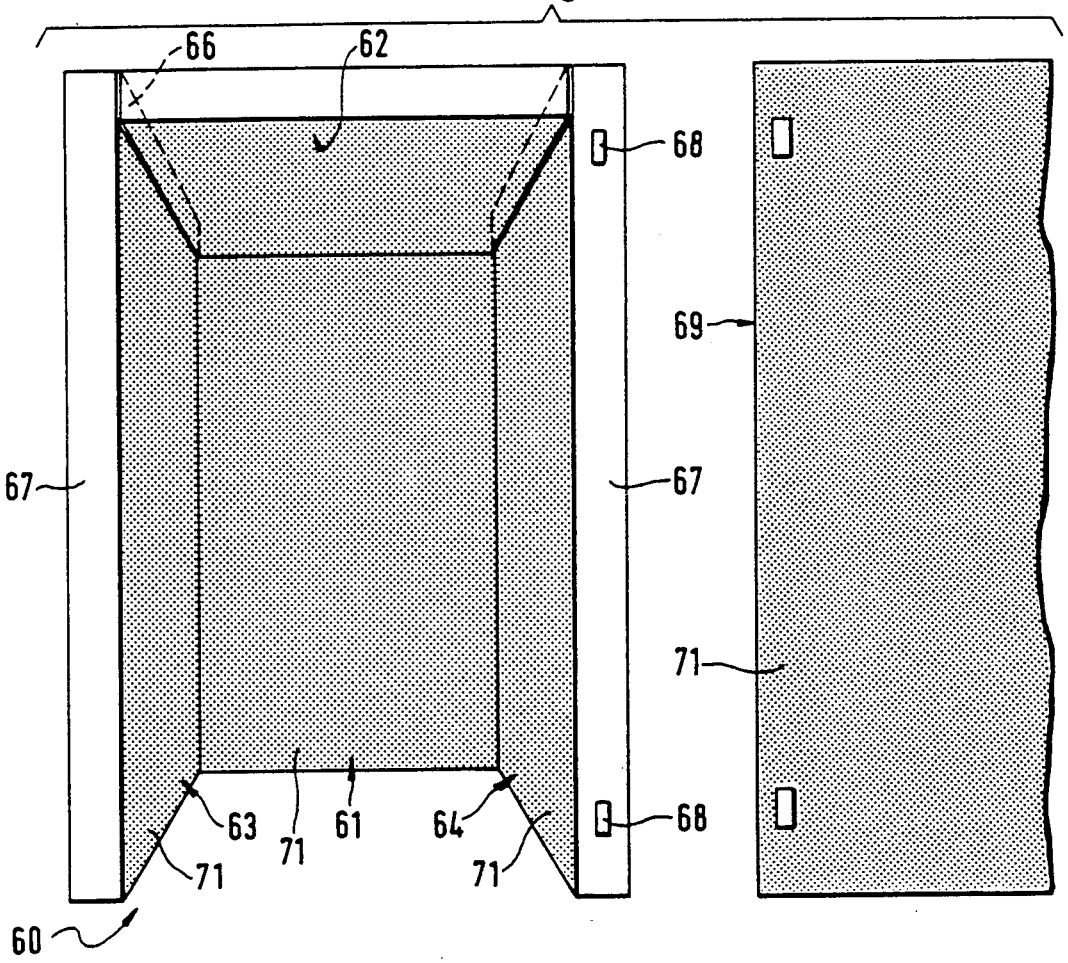
FIG. 7 shows a perspective inner view of a soundproof booth with the door removed.

Such panels formed from core 28 and foil 38 can also be used to produce a soundproof booth 60 in a simple way (FIG. 7). The rear wall is formed by a panel 61, the ceiling by a panel 62 and the two side walls by panels 63 and 64. So that these can be connected removably to one another, mutually abutting faces 66 are provided with surface fastenings in the manner of hookvelvet. In this case, the hookvelvet must be provided on four faces 66, so that the panels 61 to 64 can be connected to one another.

Set into the end face 67 of the panel 64 are two hinge halves 68 which are embedded in the foam material, for example by the use of heat, and which project from the end face 67 with their hinge part only. A fifth panel which covers the panels 61 to 64, as seen from the front, is used as a door 69. The door can likewise be provided with surface fastening means. For aesthetic reasons, but also for the sake of greater rigidity and easier cleaning, perforated sheeting 71 is glued to the panels from inside over their entire surface.

Figure 8:
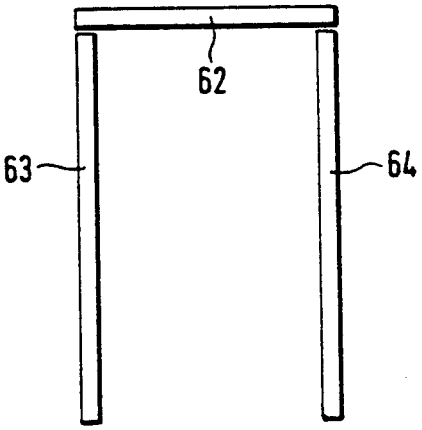
FIG. 8 shows a diagrammatical representation of a somewhat different arrangement of the panels for a soundproof booth.

FIG. 8 shows that the upper panel can also be placed on top of the two panels perpendicular to it, thus obtaining an even better connection.

Both the foam material and the adhesive can be ordered, for example, from Messrs. Dunlop Deutschland. The desired relative density must be given for the foam material.

At extremely low frequencies, it may be necessary to glue in lead sheeting in a foam/lead sheeting/foam sandwich. However, a heavy-duty sheet is usually sufficient.

I claim:

1. A large-surface, sound-proofing machine-cladding panel comprising a first layer of sound-proofing material providing form, surface dimensions and thickness of said panel, a second layer connected to said first layer over a large surface area, a first half of a connecting device on one of said layers for fastening said panel to a machine-like structure by means of a second half of said connecting device on said machine-like structure, wherein:

a) said sound-proofing material is a foam material having a thickness of at least approximately 10 cm, a plane front face, a rear face spaced from said front face by the thickness of said foam material and circumferential faces connecting said front face and said rear face;

b) said second layer is a plastic foil reinforced with a fabric and is thin in relation to said foam material thickness, has a rear face that is adhesively connected over a substantial surface area to said front face of said foam material and has wrap-around portions that extend around said circumferential faces of said foam material at least as far as said rear face of said foam material and are adhesively connected over a substantial surface area to said rear face of said foam material; and c) said first half of said connecting device is one half of a multiply reusable surface fastener that is releasable by manual force.

2. A panel as claimed in claim 1, wherein said foam material is core material used for gymnastic sports mats.

3. A panel as claimed in claim 1, wherein said foam material is continuous in one piece.

4. A panel as claimed in claim 1, wherein said foam material is composed of regenerated foam.

5. A panel as claimed in claim 1, wherein said foam material is selected from the group consisting of composite foam, polyethylene foam and polyether/polyester foam.

6. A panel as claimed in claim 1, wherein said foam material is chosen to contain less volume of air for damping lower frequencies of sound.

7. A panel as claimed in claim 1, wherein said front face and said rear face of said foam material are parallel to one another.

8. A panel as claimed in claim 1, wherein said circumferential faces of said foam material are perpendicular relative to said front face of said foam material.

9. A panel as claimed in claim 1, wherein said foam material is in the form of a flat rectangle.

10. A panel as claimed in claim 1, wherein said foil is of low extensibility.

11. A panel as claimed in claim 1, wherein said fabric is of low extensibility.

12. A panel as claimed in claim 1, wherein said fabric has a high resistance to tear propagation.

13. A panel as claimed in claim 1, wherein said foil is adhesively bonded over a large surface area thereof to said circumferential faces of said foam material.

14. A panel as claimed in claim 13, wherein said first half of said surface fastener is attached to said foil on circumferential faces thereof.

15. A panel as claimed in claim 1, wherein said foil has wrap-around portions laid back onto said rear face of said foam material, which carry said first half of said surface fastener.

16. A panel as claimed in claim 1, wherein said first half of said surface fastening is hookvelvet.

17. A panel as claimed in claim 16, wherein said first half is a hook part of said hookvelvet.

18. A panel as claimed in claim 1, wherein said surface fastener comprises a plurality of individual pads that are small in relation to said surface dimensions of said first layer of sound-proofing material.

19. A panel as claimed in claim 18, wherein at least one pad is provided in four corner regions of approximately flat rectangular panels of said wrap-around portions of said foil.

20. A panel as claimed in claim 1, wherein said other half of said surface fastener is provided on a tab which extends from an interior of a machine stand frame into a space to be filled by said panel.

21. A panel as claimed in claim 1, wherein said foam material consists of at least two sandwich layers with surface areas and with at least one stiffening insert, which are connected to one another materially and over their entire surface areas.

22. A panel according to one of claims 1 through 21 that constitutes, at least partially, a wall of a booth.

23. A panel as claimed in claim wherein said first and second layers form a door, and door-hinge sockets are embedded into a door edge of said first and second layers forming said door and into first and second panel-forming layers forming an associated wall.

* * * * *